US006264431B1

(12) United States Patent
Triezenberg

(10) Patent No.: US 6,264,431 B1
(45) Date of Patent: Jul. 24, 2001

(54) VARIABLE-SPEED MOTOR DRIVE CONTROLLER FOR A PUMP-MOTOR ASSEMBLY

(75) Inventor: David M. Triezenberg, Fort Wayne, IN (US)

(73) Assignee: Franklin Electric Co., Inc., Bluffton, IN (US)

( * ) Notice: Subject to any disclaimer, the term of this patent is extended or adjusted under 35 U.S.C. 154(b) by 0 days.

(21) Appl. No.: 09/312,880

(22) Filed: May 17, 1999

(51) Int. Cl.[7] ..... F04B 49/00

(52) U.S. Cl. ..... 417/36; 417/19

(58) Field of Search ..... 60/452, 39.281; 137/566, 351; 73/290 R; 123/520; 239/153; 222/52, 55; 248/424; 264/40.3; 318/482; 361/31; 417/34, 36, 20, 8, 45, 19, 44.2, 26

(56) References Cited

U.S. PATENT DOCUMENTS

| | | | | |
|---|---|---|---|---|
| 3,072,060 | | 1/1963 | Waite | 103/25 |
| 3,097,606 | | 7/1963 | Finzel | 103/23 |
| 3,612,950 | | 10/1971 | Knott | 317/13 B |
| 3,782,634 | * | 1/1974 | Herman | 239/156 |
| 3,800,205 | | 3/1974 | Zalar | 318/482 |
| 3,801,889 | | 4/1974 | Quinn | 318/481 |
| 3,894,811 | * | 7/1975 | Bergey et al. | 417/34 |
| 3,908,360 | * | 9/1975 | Meyer et al. | 60/39.281 |
| 3,922,111 | | 11/1975 | Deters | 417/26 |
| 3,937,596 | * | 2/1976 | Braidwood | 417/36 |
| 3,958,898 | * | 5/1976 | Abrahams et al. | 417/36 |
| 3,963,375 | | 6/1976 | Curtis | 417/12 |
| 4,000,446 | | 12/1976 | Vandevier et al. | 317/36 TD |
| 4,021,700 | | 5/1977 | Ellis-Anwyl | 361/28 |
| 4,131,216 | * | 12/1978 | Gerstenmaier et al. | 222/52 |
| 4,166,713 | | 9/1979 | Debrey | 417/40 |
| 4,186,769 | * | 2/1980 | Buyce | 137/566 |
| 4,208,871 | * | 6/1980 | Riple, Jr. | 60/39.281 |
| 4,292,994 | * | 10/1981 | Johnson et al. | 137/351 |
| 4,302,158 | * | 11/1981 | Brown | 417/20 |
| 4,307,327 | | 12/1981 | Streater et al. | 318/786 |
| 4,329,120 | | 5/1982 | Walters | 417/12 |
| 4,341,504 | * | 7/1982 | Hignutt et al. | 417/8 |
| 4,346,867 | * | 8/1982 | Dick et al. | 248/424 |
| 4,410,924 | | 10/1983 | Hewitt et al. | 361/25 |
| 4,441,860 | | 4/1984 | Tsujimoto | 417/40 |
| 4,444,545 | * | 4/1984 | Sanders et al. | 417/8 |
| 4,462,758 | | 7/1984 | Speed | 417/38 |
| 4,529,359 | * | 7/1985 | Sloan | 417/34 |
| 4,546,300 | | 10/1985 | Shaikh | 318/786 |
| 4,583,916 | * | 4/1986 | Senghaas et al. | 417/36 |
| 4,628,236 | | 12/1986 | Schaefer | 318/558 |

(List continued on next page.)

OTHER PUBLICATIONS

Driscoll, Fletcher G., *Groundwater and Wells*, 2d edition, p. 626 (Johnson Division, St.Paul, Minnesota 1986).

"Submersible Pump Operation & Installation," excerpt for *Water Systems Handbook*, 8th edition, pp. 25–31 (Water Systems Council, Aug. 1983).

(List continued on next page.)

*Primary Examiner*—Teresa Walberg
*Assistant Examiner*—Leonid Fastovsky
(74) *Attorney, Agent, or Firm*—Marshall, O'Toole, Gerstein, Murray & Borun

(57) ABSTRACT

A liquid pump system for providing liquid to a tank includes a variable-speed motor drive and a control circuit coupling the variable-speed motor drive to a power source. The control circuit has a switch that may be disposed in a state according to the amount of liquid in the tank. The control circuit provides for supplying power to the variable-speed motor drive from the power source regardless of the state of the switch. The control circuit may include a transmitter that generates a high frequency signal representative of the state of the switch. In that embodiment, a detector coupled to the variable-speed motor drive receives the high frequency signal to control operation of the liquid pump system.

45 Claims, 10 Drawing Sheets

U.S. PATENT DOCUMENTS

| | | | | |
|---|---|---|---|---|
| 4,652,802 | * | 3/1987 | Johnston | 318/482 |
| 4,678,404 | * | 7/1987 | Lorett et al. | 417/45 |
| 4,686,439 | | 8/1987 | Cunningham et al. | 318/335 |
| 4,728,264 | | 3/1988 | Tuckey | 417/44 |
| 4,808,078 | | 2/1989 | Havens et al. | 417/38 |
| 4,972,709 | * | 11/1990 | Bailey, Jr. et al. | 73/290 R |
| 4,998,097 | | 3/1991 | Noth et al. | 340/648 |
| 5,008,051 | * | 4/1991 | DeCoursey et al. | 264/40.3 |
| 5,076,761 | | 12/1991 | Krohn et al. | 417/18 |
| 5,145,323 | | 9/1992 | Farr | 417/36 |
| 5,160,244 | * | 11/1992 | Kuwabara et al. | 417/36 |
| 5,197,859 | * | 3/1993 | Siff | 417/19 |
| 5,213,477 | * | 5/1993 | Watanabe et al. | 417/20 |
| 5,281,101 | | 1/1994 | Bevington | 417/38 |
| 5,340,281 | | 8/1994 | Su | 417/12 |
| 5,499,614 | * | 3/1996 | Busato et al. | 123/520 |
| 5,518,371 | | 5/1996 | Wellstein et al. | 417/44.9 |
| 5,528,911 | * | 6/1996 | Roth et al. | 60/452 |
| 5,549,447 | | 8/1996 | Bevington | 415/115 |
| 5,577,890 | | 11/1996 | Nielsen et al. | 417/44.2 |
| 5,580,221 | | 12/1996 | Triezenberg | 417/44.2 |
| 5,700,138 | | 12/1997 | Bevington | 417/366 |
| 5,764,463 | * | 6/1998 | Arvidson et al. | 361/31 |
| 5,772,403 | * | 6/1998 | Allison et al. | 417/44.2 |
| 5,934,508 | * | 8/1999 | Kenney et al. | 222/55 |
| 6,053,702 | * | 4/2000 | Sears | 417/26 |
| 6,070,760 | * | 6/2000 | Kenney et al. | 222/55 |

OTHER PUBLICATIONS

"Pressure Tanks and Water Systems Controls," excerpt from *Water Systems Handbook*, 8th edition, pp. 58–59 (Water Systems Councill, Aug. 1983).

"Pitless Well Adapters," excerpt from *Water Systems Handbook*, 8th edition, pp. 66–67 (Water Systems Council, Aug. 1983).

"Constant Pressure Water For Private Well Systems," Myers Pentair Pump Group brochure for Emerald Elite Constant Pressure Water System (date known).

"Constant Pressure Water For Private Well Systems," Myers Pentair Pump Group Brochure for Emerald Elite Constant Pressure Water System (date unknown).

"*SQ, SQE Submersible Pumps*," Grundfos manual (date unknown).

Grundfos CU300 manual, pp. 10–15 (date unknown).

* cited by examiner

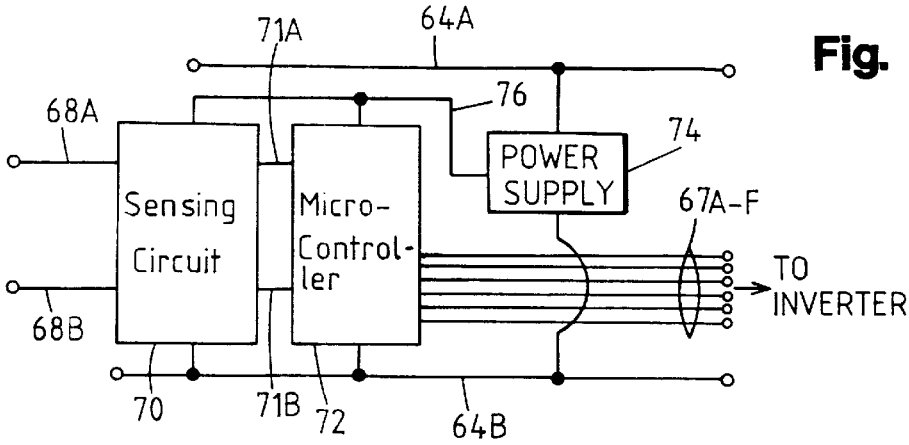
Fig. 4
Fig. 5A
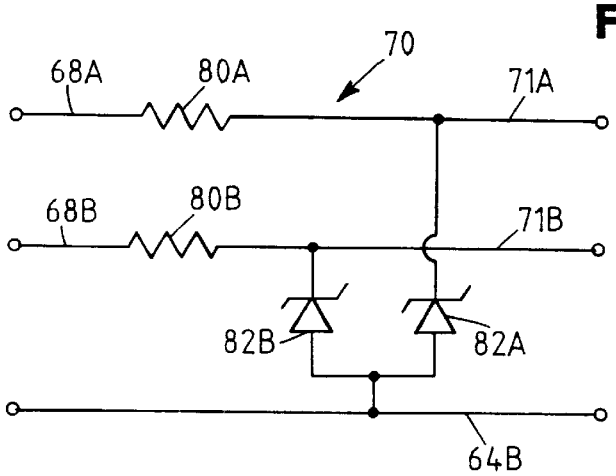
Fig. 5B
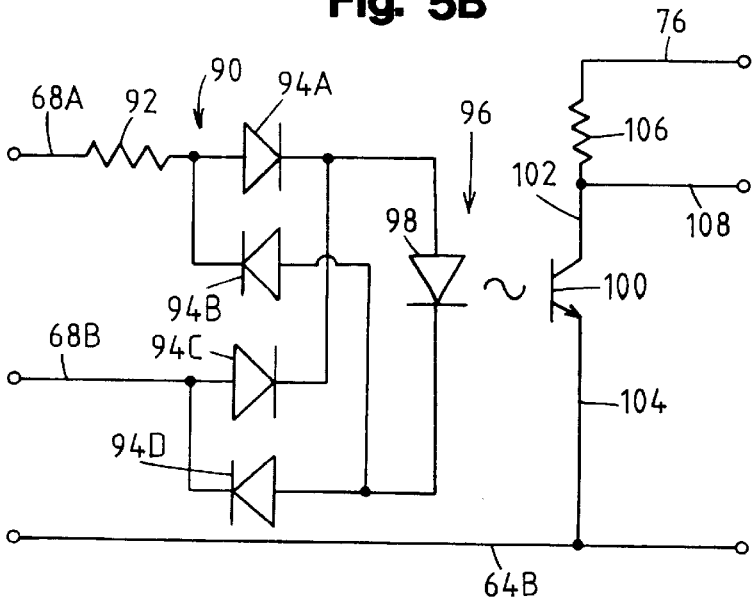

VARIABLE-SPEED MOTOR DRIVE CONTROLLER FOR A PUMP-MOTOR ASSEMBLY

BACKGROUND OF THE INVENTION

1. Field of the Invention

The invention relates generally to liquid pump systems and, more particularly, to circuitry for controlling a variable-speed motor drive thereof.

2. Description of the Related Art

Domestic water systems typically include a line-operated (i.e., 60 Hz, single-phase power) motor for driving a pump-motor assembly to retrieve water from a well. The pump-motor assembly is generally submerged in the well at the end of a drop pipe. A less efficient alternative configuration is a surface-mounted jet pump and submerged ejector nozzle.

To maintain an approximately constant supply pressure, these water systems also typically include a pressurized storage tank and a pressure sensing switch (hereinafter "pressure switch") that causes the pump-motor assembly to run when pressure is low (i.e., when the tank water level is low) and stop when pressure is high (i.e., when the tank water level is high). However, starting single-phase motors is inefficient and cannot be repeated too frequently or the motor will overheat. As a result, typical domestic water systems use a relatively large pressure tank (e.g., 20 gallons) and a relatively large pressure differential (e.g., 20 psi) to limit the frequency of motor starting.

Recent progress in power electronics has resulted in the incorporation of a frequency changer (i.e., variable-speed motor drive) in the pump-motor assembly. Frequency control has allowed the motor to be operated at higher speeds than the 3450 rpm typical of 60 Hz line-operated motors, in turn allowing the pump to be physically smaller. For submersible pumps, this advantage is realized in a reduction in the number of stages, inasmuch as the size of each stage in a multi-stage submersible pump is restricted by the well bore diameter. Another advantage of a variable-speed pump-motor assembly involves "soft starting," or ramping up the speed of the motor during starting to provide a more efficient startup procedure.

In one such variable-speed motor-pump assembly, the variable-speed motor drive was included as part of a submerged pump-motor assembly unit. A pressure switch located near the pressure tank was utilized to cut power to the pump-motor assembly once the pressure reached a predetermined high level. Cutting power to the pump-motor assembly, however, would also de-energize the variable-speed motor drive. As a result, a capacitor bank in the variable-speed motor drive had to be recharged during every startup. Recharging the capacitor bank, particularly if done quickly, places extreme stresses on the rectifiers that supply current to the capacitor bank. Reducing the recharge rate to avoid damage to the rectifier, however, undesirably decreases the responsiveness of the pump-motor assembly. A lower responsiveness translates into a larger tank.

Another variable-speed system similarly cut the power to the pump-motor assembly via a control unit disposed near the tank. In this system, a pressure switch near the control unit coupled a pair of signal conductors to the control unit. These signal conductors then led to the variable-speed motor drive via a cable separate from the power conductors carrying the 60 Hz power.

Other variable-speed systems have replaced the on/off signal of a pressure switch with an analog control signal developed by a pressure transducer. The pressure transducer signal has also been delivered as a digital signal to the embedded microcontroller, which can then decide to start, stop, or adjust: the speed of the motor. Generally, these systems relying upon a pressure transducer have often severely limited the closed loop bandwidth in order to maintain system stability. This bandwidth limitation significantly decreases the responsiveness of the system. Other systems have had to utilize a flow sensor in addition to the transducer to determine when the pump-motor assembly should completely shut down.

SUMMARY OF THE INVENTION

In accordance with one aspect of the present invention, a pump system is useful for providing liquid to a tank. The pump system includes a variable-speed motor drive and a pair of conductors coupled thereto to supply power to the variable-speed motor drive. The pump system further includes a switch disposed in a state in accordance with an amount of liquid in the tank. The switch is coupled to at least one conductor of the pair of conductors for control of the variable-speed motor drive and power is supplied to the variable-speed motor drive via the pair of conductors regardless of the state of the switch.

According to a preferred embodiment, the pump system further includes a third conductor coupling the switch to the variable-speed motor drive. Alternatively, the pump system further includes a bypass circuit connected to at least one of the pair of conductors in parallel with the switch. The bypass circuit may include a rectifying element such that the pump system further includes a sensor coupled to the variable-speed motor drive that detects whether the pair of conductors are supplying half-wave rectified power.

According to another preferred embodiment, the pump system further includes a transmitter coupled to the switch and the pair of conductors to generate a high frequency signal on the pair of conductors representative of the state of the switch. The pump system may further include a detector coupled to the pair of conductors and the variable-speed motor drive that is responsive to the high frequency signal to control the variable-speed motor drive.

In accordance with another aspect of the present invention, a pump system powered by a power source for providing liquid to a tank includes a variable-speed motor drive and a control circuit coupled to the power source and the variable-speed motor drive. The control circuit, in turn, includes a switch disposed in a state in accordance with an amount of liquid in the tank, and a bypass circuit connected in parallel with the switch that allows power to be supplied to the variable-speed motor drive from the power source regardless of the state of the switch.

In accordance with yet another aspect of the present invention, a pump system useful for providing liquid to a tank includes a variable-speed motor drive and a pair of conductors coupled to the variable-speed motor drive to supply power thereto. The pump system further includes a transmitter inductively coupled to the pair of conductors to generate a high frequency signal representative of an amount of liquid in the tank. A detector of the pump system is coupled to the variable-speed motor drive and inductively coupled to the pair of conductors to receive the high frequency signal therefrom.

The pump system preferably includes a mechanism coupled to the transmitter for indicating the amount of liquid in the tank. This mechanism may include a pressure switch disposed in a state in accordance with the amount of liquid in the tank.

According to a preferred embodiment, the pump system further includes a pair of capacitors connected across the pair of conductors. The transmitter and the detector may then be coupled to the pair of conductors via a respective transformer such that each transformer, together with a respective capacitor of the pair of capacitors, couples the pair of conductors together.

According to another preferred embodiment, the transmitter includes an oscillator. The transmitter may further include an amplifier coupled to the oscillator via a switch that is disposed in a closed state when the amount of liquid in the tank reaches a low level.

In accordance with a still further aspect of the present invention, a control circuit is useful in a pump system having a tank for storing liquid and a variable-speed motor drive. The control circuit includes a switch disposed in a state in accordance with an amount of liquid in the tank and a bypass circuit connected in parallel with the switch. As a result, the variable-speed motor drive is supplied with power when the switch is disposed in an open state. The control circuit further includes a detector responsive to the power to generate a control signal representative of the state of the switch to control the variable-speed motor drive.

In accordance with yet a further aspect of the present invention, a control circuit for a pump system having a variable-speed motor drive and a tank for storing liquid includes a mechanism for indicating an amount of liquid in the tank, and first and second power conductors that supply power to the variable-speed motor drive. The control circuit further includes a transmitter coupled to the indicating mechanism and at least one of the first and second power conductors to generate a high frequency signal representative of the amount of liquid in the tank. A detector coupled to at least one of the first and second power conductors and to the variable-speed motor drive is then responsive to the high frequency signal to control the variable-speed motor drive.

Preferably, the indicating mechanism includes a pressure switch disposed in a state in accordance with the amount of liquid in the tank. The transmitter and the detector may be inductively coupled to at least one of the first and second power conductors via a first transformer and a second transformer, respectively. A first capacitance and the first transformer may then couple the first power conductor to the second power conductor, while a second capacitance and the second transformer may also couple the first power conductor to the second power conductor.

According to a preferred embodiment, the transmitter comprises an oscillator. The transmitter may further include an amplifier coupled to the oscillator and responsive to the indicating mechanism.

In accordance with a still further aspect of the present invention, a controller is useful for a variable-speed motor drive provided with current from a power source for pumping liquid to a tank. The controller includes a pressure-sensitive device having a diaphragm responsive to an amount of liquid in the tank. Coupled to the pressure-sensitive device is a current-carrier circuit having a transformer, which is saturated by the current. The current-carrier circuit is also coupled to the variable-speed motor drive to provide to the variable-speed motor drive a signal indicative of the amount of liquid in the tank.

The pressure-sensitive device preferably includes a switch having a state determined by a position of the diaphragm. The transformer preferably includes a ferrite core.

BRIEF DESCRIPTION OF THE DRAWINGS

FIG. 4 is a schematic diagram of an inverter control of the variable-speed motor drive of FIG. 3;

FIG. 5A is a schematic diagram of a sensing circuit according to one embodiment of the present invention for use in the inverter control of FIG. 4;

FIG. 5B is a schematic diagram of a sensing circuit according to another embodiment of the present invention for use in the inverter control of FIG. 4;

DETAILED DESCRIPTION OF THE INVENTION

Figure 1:
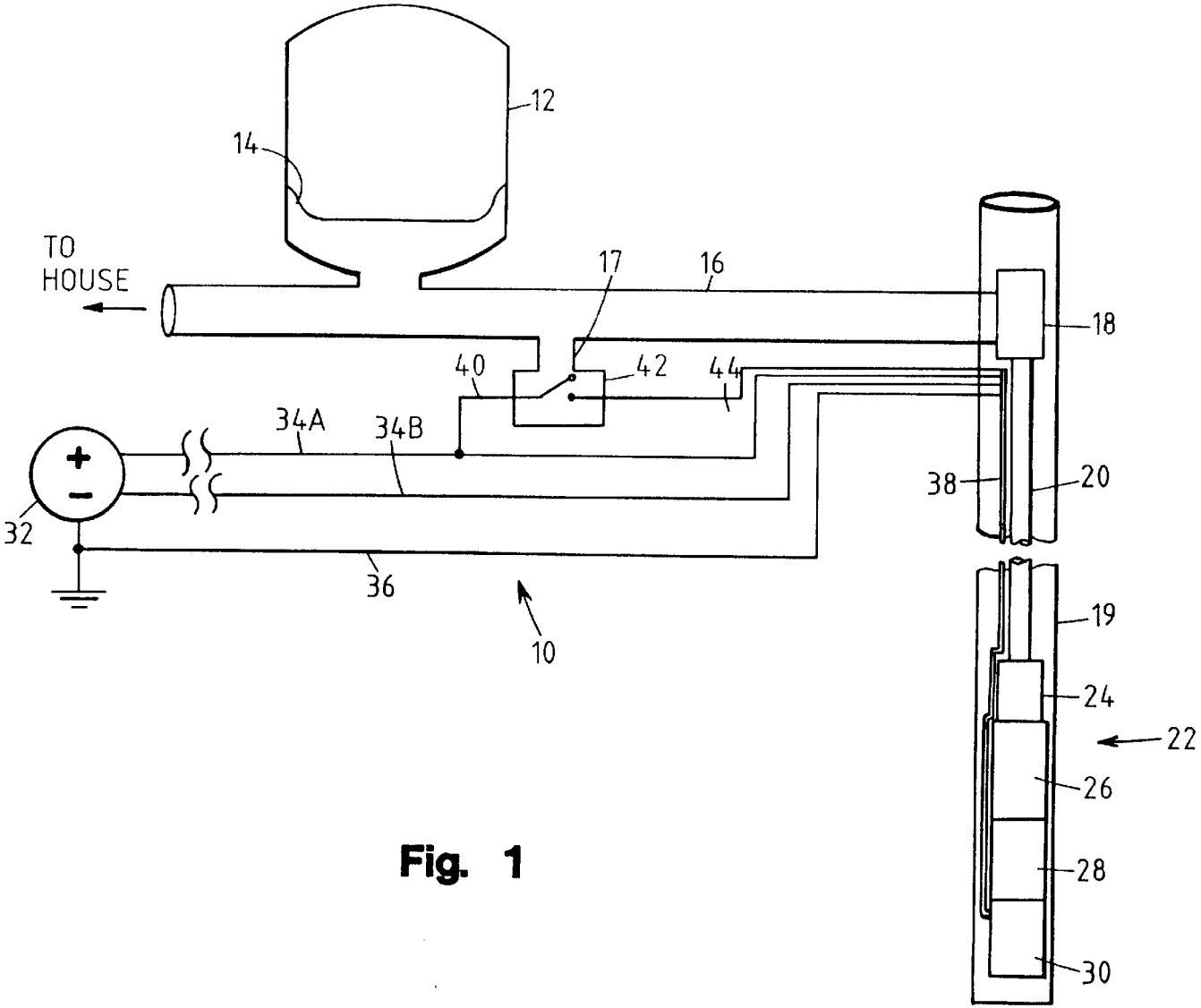
FIG. 1 is a diagrammatic representation of a liquid pump system according to one embodiment of the present invention.

Referring to FIG. 1, a domestic water system 10 for retrieving water from a well includes a storage tank 12 having a diaphragm 14, ground-level piping 16, a pitless adapter (or pump-discharge elbow) 18, a well casing 19, and a drop pipe 20 extending down into the well casing 19. The diaphragm 14 is a conventional mechanism for pressurizing the system 10 between, for instance, 30 and 50 psi without having to use an inordinate amount of water. The diaphragm 14 also prevents the absorption of the captive air used to pressurize the system 10, thereby avoiding excessive pressure fluctuations. The piping 16 couples the drop pipe 20 to the tank 12 and further couples the tank 12 to the remainder (not shown) of the system 10 (e.g., the house plumbing). A relief valve (not shown), a pressure gauge (not shown), and other standard components of a domestic water system may be disposed along the piping 16 as is known to those skilled in the art. Further information regarding such components may be found in the *Water Systems Handbook* (10th ed. Water Systems Council 1993), the disclosure of which is hereby incorporated by reference.

The drop pipe 20 terminates in a pump-motor assembly 22, which may include a check valve 24, a submersible pump 26, a variable-speed motor 28, and a variable-speed motor drive 30. The check valve 24 may be disposed at any point in the system above the pump 26, but is preferably disposed as shown (i.e., on the discharge side of the pump 26) to prevent backflow through the pump 26. The check valve 24 may be of any type known to those skilled in the art, including, for example, flapper or poppet valves. Additional check valves (not shown) may be disposed at other points along the piping 16.

The pump-motor assembly 22 need not be submersed in the well at the end of the drop pipe 20. In fact, the pump 26 may be any pump suitable for use with a variable-speed motor and may comprise a line shaft pump or a horizontal centrifugal pump disposed at ground level. The type of pump may be selected on the basis of elevation head and water demand requirements. However, the pump-motor assembly 22 preferably comprises a centrifugal, in-line submersible pump. It should also be noted that the pump 26 may comprise multiple stages of impellers (not shown) and diffusers (not shown) to meet high water head requirements.

The variable-speed motor drive 30 is provided with power from a power source 32 via a pair of power conductors 34A and 34B. The power source 32 may supply 230 Volts at 60 Hz or at any other voltage or frequency (e.g., 220 Volts at 50 Hz). The power conductors 34A–34B, along with a third, grounded conductor 36, are provided to the pump-motor assembly 22 via a drop cable 38, which may be taped or otherwise attached to the piping 16 and/or the drop pipe 20. As is known to those skilled in the art, the power conductors 34A–34B may also pass through a disconnect switch (not shown) and/or a control box (not shown) that are disposed at ground level for manual control of the pump-motor assembly 22.

The above-described system 10 will now be set forth in connection with several embodiments of the present invention that provide for the remote signaling of the state of the system to the pump-motor assembly 22. In each embodiment, such remote signaling is accomplished while continuously providing power to the variable-speed motor drive 30. The uninterrupted supply of power to the variable-speed motor drive 30 maintains the pump-motor assembly 22 in a ready-to-run mode for high rates of on-off cycling.

Although the present invention is particularly well-suited for use with a domestic water system and will be discussed in that context herein, a person of ordinary skill in the art will readily appreciate that the teachings of the present invention are in no way limited to such an environment of use. On the contrary, the present invention may be employed in any liquid pump system that would benefit from remote signaling and control of a variable-speed motor drive.

According to one embodiment of the present invention, an additional conductor 40 is coupled to one of the power conductors 34A–34B. The conductor 40 is interrupted by a control circuit having a switch 42 that, as described in greater detail hereinbelow, preferably comprises a triac or other semiconductor switching device driven or otherwise controlled by a pressure or float (level) switch coupled to the tank 12 or the piping 16 via a conduit 17 or other connection. Alternatively, the switch 42 includes equivalent mechanical components driven by the pressure or float switch. In general, however, the switch 42 may be disposed in one of two states (e.g., ON or OFF) indicative of the amount (i.e., volume or pressure) of the liquid in the tank 12. More particularly, the state of the switch is determined by whether the pressure or float switch indicates a predetermined high or low liquid condition. The state of the switch 42 is then determinative of an electrical property of a control signal transmitted to the variable-speed motor drive 30 via a conductor or signal line 44. Providing the control signal via the conductor 44, in turn, allows power to be continuously supplied to the variable-speed motor drive 30 via the conductors 34A and 34B, regardless of whether the control circuit is indicating that the tank is full, sufficiently full, or at some other predetermined liquid level.

The variable-speed motor drive 30 accordingly includes circuitry responsive to the signal on the conductor 44. Such circuitry determines whether to initiate or cease the pumping of liquid or, more particularly, whether to begin accelerating or decelerating the variable-speed motor 28. For example, the variable-speed motor drive 30 may determine whether the signal is floating or driven by the power source 32 to be an AC waveform. On the basis of that determination, the variable-speed motor drive 30 may alternate the speed of the motor 28 between a high level and a low level, or decelerate the motor 28 to a complete stop.

Figure 2:
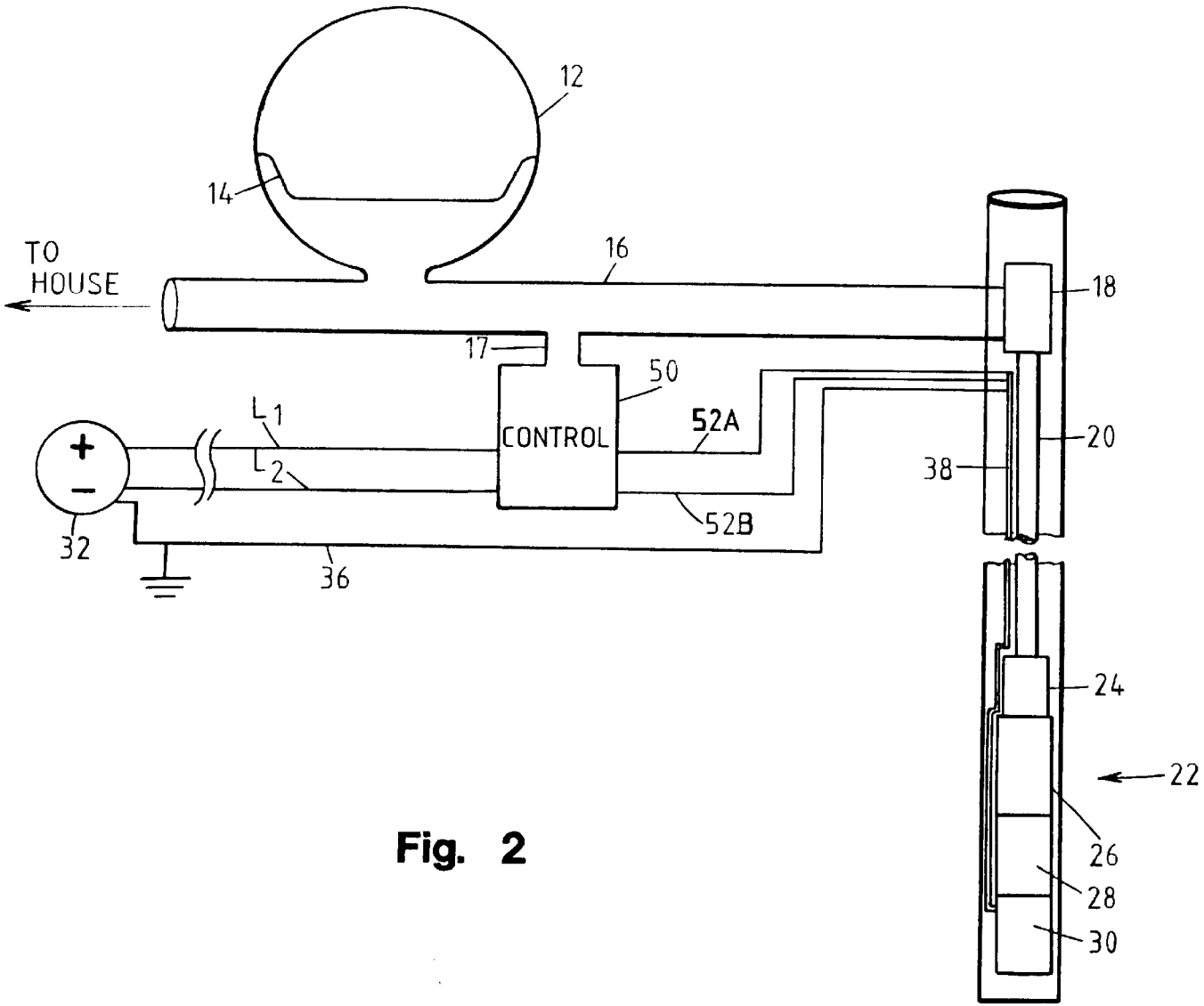
FIG. 2 is a diagrammatic representation of a liquid pump system according to another embodiment of the present invention.

Referring now to FIG. 2, where like elements of FIG. 1 have been identified with like reference numerals, a pair of power conductors L1 and L2 couple the power source 32 to a control circuit 50. The control circuit 50, in turn, is coupled to a pair of power conductors 52A and 52B that lead to the pump-motor assembly 22 to supply power thereto. The power conductors 52A–52B, along with the grounded conductor 36, may be carried to the submersed pump-motor assembly 22 via the drop cable 38.

As in the foregoing embodiment of FIG. 1, the control circuit 50 determines an electrical property of a control signal transmitted to the variable-speed motor drive 30 that is indicative of the amount of the liquid in the tank 12. To this end, the control circuit 50 is coupled via the conduit 17 (or otherwise) to the piping 16 or anywhere in the system above the check valve 24. Unlike the foregoing embodiment however, the signal providing information regarding the amount of liquid in the system 10 is transmitted over one or both of the power conductors 52A and 52B.

Figure 3:
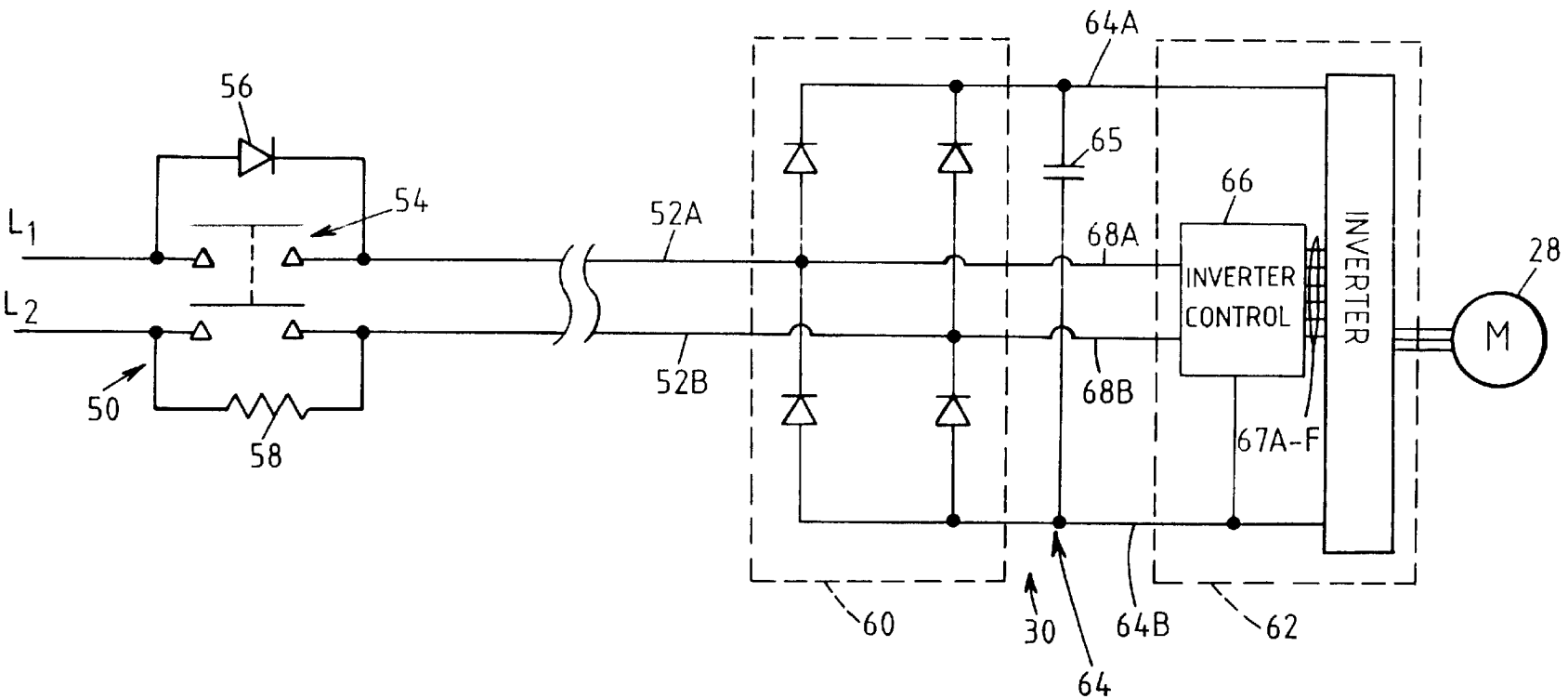
FIG. 3 is a schematic diagram of a control circuit and variable-speed motor drive of the liquid pump system of FIG. 2.

The control circuit 50 is schematically shown in greater detail in FIG. 3. According to one embodiment of the present invention, the control circuit 50 includes a double contactor switch 54 operable to connect two pairs of power conductors, namely the power conductors L1 and 52A and the power conductors L2 and 52B. The double contactor switch 54 may be driven by a pressure or float (level) switch, as described hereinbelow. In general, the double contactor switch 54 will be open or closed in the event that the pressure or float switch senses a predetermined high or low amount of water in the tank 12, respectively. It should again be noted that the level or amount of water in the tank 12 may be measured in terms of pressure, volume, or any other related property indicative thereof.

In accordance with one embodiment of the present invention, the control circuit 50 includes a bypass circuit having a diode 56 and a resistor 58, the bypass circuit being connected in parallel across the contacts of the switch 54. In general, the rectifying nature of the diode 56 permits power to be supplied to the variable-speed motor drive 28, while still allowing the switch 54 to control the operation of the pump-motor assembly 22. Specifically, when the switch 54 is open, the diode 56 and the resistor 58 permit a half-wave rectified signal to be transmitted to the variable-speed motor drive 30. The variable-speed motor drive 30 then includes circuitry for distinguishing between half-wave rectified and non-rectified signals to determine the state of the switch 54. Such circuitry then generally controls the speed of the motor 28, and, more particulary, whether the motor 28 should be accelerating, decelerating, or remain fully on or off.

In this manner, the bypass circuit and the power conductors 52A and 52B provide a mechanism for controlling the variable-speed drive 30 while also continually supplying power thereto. Unlike the embodiment of FIG. 1, these results are accomplished without the addition of a third conductor. Similar to the embodiment of FIG. 1, however, the control circuit 50 still distinguishes between low and high water conditions via a switch to control the operation of the pump-motor assembly 22.

In general, the variable-speed motor drive 30 includes a rectifier 60 coupled to an inverter 62 via a DC link 64. The rectifier 60 includes a plurality of diodes that rectify the signal transmitted over the power conductors 52A–52B. The rectified signal is, in turn, provided to a capacitor or capacitor bank 65 that establishes a voltage $V_{DC}$ across lines 64A and 64B, which together form the DC link 64. The voltage $V_{DC}$ is provided to the inverter 62 to generate three-phase, variable-frequency power for the motor 28. The inverter 62 includes a plurality of inverter switches (e.g., six transistor circuits) that are driven by an inverter control 66 via lines 67A–67F. Such components of a typical inverter 62 are well known to those skilled in the art and will not be further described.

In accordance with one embodiment of the present invention, the inverter control 66 includes additional circuitry for analyzing whether a half-wave rectified or non-rectified signal has been transmitted to the variable-speed motor drive 30. In this manner, the inverter control 66 selectively provides a plurality of switch signals on the lines 67A–67F according to the amount of the liquid in the tank 12. To this end, the inverter control 66 is coupled to the power conductors 52A–52B by a pair of conductors 68A and 68B. Alternatively, the inverter control 66 is coupled to only one power conductor (e.g., the power conductor 52A). However, the inverter control 66 preferably receives signals via both of the conductors 68A–68B because it may be difficult to distinguish between the power conductors 52A–52B during installation. In this manner, if an installer becomes confused as to the identities of the power conductors 52A–52B, the circuit will still function in the event of a miswiring.

If the inverter control 66 senses a half-wave rectified signal on either the line 68A or the line 68B (meaning that the amount or pressure of the water in the tank 12 has met or exceeded the predetermined high level), the inverter control 66 either (1) continues to withhold the switch signals from the transistor circuits in the inverter 62, or (2) begins to decelerate the variable-speed motor 28 via appropriate switch signals. As a result, the pump-motor assembly 22 will eventually, if not already, be inactivated or assume a state where the motor 28 is running at a predetermined low speed. If the switch 54 has just recently been opened, the switch signals decelerate the motor 28 in a dynamic braking fashion. In this manner, if the motor 28 has not decelerated to a stop by the time the switch 54 re-closes, the inverter 62 is still synchronized with the motor 28 and the position of the rotor (not shown) of the motor 28 is known for proper commutation. Consequently, the inverter 62 need not go through its standard initialization process to determine the timing of the commutation signals sent to the motor 28.

The inverter control 66 is shown in greater detail in FIG. 4. In this embodiment, the inverter control 66 includes a detecting or sensing circuit 70 responsive to the signals provided on the lines 68A–68B to develop control signals on lines 71A and 71B. The control signals are preferably digital for interpretation by a microcontroller 72 that is configured (via any combination of hardware, software, and firmware) to develop the switch signals on the lines 67A–67F. In this case, the general purpose of the sensing or detecting circuit 70 is to convert the analog indication of the state of the switch 54 into a digital control signal recognizable by the microcontroller 72. In this manner, the sensing circuit 70 and the microcontroller 72 distinguish between the half-wave rectified and non-rectified current that may be carried by the power conductors 52A and 52B. It will be appreciated by those skilled in the art that many different circuits may be readily designed to distinguish between such types of analog signals. Moreover, many different circuits are known to those skilled in the art for generating respective digital representations of these analog signals. It should also be noted that the sensing circuit 70 may be physically housed in a module separate from the variable-speed motor drive 30 and, therefore, may or may not be considered a component thereof.

Power is supplied to the sensing circuit 70 and the microcontroller 72 by a power supply 74, which may comprise a voltage regulator, a voltage divider, or some other circuit known to those skilled in the art for providing a constant DC voltage suitable for logic circuits. More particularly, the power supply 74 provides via a line 76 a DC voltage $V_L$, which is preferably a sufficiently low voltage with respect to the voltage on the line 64B (e.g., about five volts above $-V_{DC}/2$). The line 64B accordingly provides a common reference voltage for the sensing circuit 70 and the microcontroller 72.

The manner in which the variable-speed motor drive 30 continuously remains in a ready-to-run mode regardless of the state of the switch 54 (FIG. 3) will now be described. Because the bypass circuit allows current to flow in the power conductors 52A–52B whether the switch 54 is open or closed, the capacitor 65 remains charged even though the motor 28 may have slowed to a stop or been otherwise inactivated. Keeping the capacitor 65 charged means that the DC link 64 continuously provides the voltage $V_{DC}$ to the power supply 74, which, in turn, continuously supplies the voltage $V_L$ to the microcontroller 72. As a result, the microcontroller 72 need not be initialized even if the motor 28 has decelerated to a stop. Furthermore, the delay associated with charging the capacitor 65 is removed from the start-up sequence. Still further, the stress placed on the rectifiers 60 during charging is avoided altogether.

Referring now to FIG. 5A, the sensing or detecting circuit 70 according to one embodiment of the present invention includes a pair of resistors 80A and 80B and a pair of zener diodes 82A and 82B. The resistors 80A–80B couple the lines 68A–68B to the lines 71A–71B, respectively, and limit the reverse-break down current flowing through the zener diodes 82A–82B. Such current limitation is necessary because the voltages on the lines 68A–68B may be very high relative to $-V_{DC}/2$, the voltage on the line 64B. The zener diodes 82A–82B have a reverse breakdown voltage set slightly higher than the logic threshold $V_T$ of the microcontroller 72. Thus, each time the signal on either of the lines 71A–71B reaches a voltage equal or exceeding approximately $-V_{DC}/2+V_T$, the respective zener diode 82A or 82B will breakdown to regulate the voltage at roughly that level. In so doing, the sensing circuit 70 provides a logic pulse to the microcontroller 72 once per cycle on the line 71A, and also on the line 71B. In the event that the signal on either of the lines 71A–71B does not exceed that value, the respective zener diode 82A–82B will essentially maintain the voltage on the respective line 71A or 71B at about $-V_{DC}/2$. The microcontroller 72 interprets such a signal as a logic low, inasmuch as it roughly equals the reference voltage of the microcontroller, namely $-V_{DC}/2$.

The above-described operation of the sensing circuit 70 will now be set forth as applied to the control signal provided by the control circuit 50. If the switch 54 of the control circuit 50 is closed, the lines 68A–68B carry a full sinusoidal signal that dips below $-V_{DC}/2+V_T$ during each cycle. As a result, the signal on the corresponding line 71A–71B pulses once-per-cycle. When the switch 54 opens, the current on one of the lines 68A–68B is half-wave rectified by the diode 56. The signal on the corresponding line 71A or 71B then becomes positive with respect to $-V_{DC}/2+V_T$ and, therefore, the corresponding zener diode 82A or 82B will be in reverse breakdown. The microcontroller 72 then receives a constant logic high from the sensing circuit 70 as opposed to the one-pulse-per-cycle signal received when the switch 54 is closed. The microcontroller 72 is accordingly configured via any combination of hardware, firmware, and software to respond to such a signal to generate switch signals to decelerate and/or stop the motor 28.

The structure and/or programming of the microcontroller 72 is well known to those skilled in the art and will not be further described herein. It will further be appreciated that alternative circuits for generating the signals on the lines 71A–71B together with the appropriate switch signals are readily discernible to those skilled in the art from the foregoing description. Such circuits may, for instance, include analog-to-digital converter and digital comparator circuits well known to those skilled in the art.

A sensing circuit similar to that shown in FIG. 5A may be constructed for use with the embodiment of the present invention shown in FIG. 1. More particularly, a zener diode with a reverse breakdown voltage similar to those of FIG. 5A could couple the line 44 (FIG. 1) to $-V_{DC}/2$, thereby providing a pulse train at 60 Hz if the switch 42 (FIG. 1) is closed. If the switch 42 is open, the pulse train would cease.

Referring now to FIG. 5B, in an alternative embodiment of the present invention, a sensing or detecting circuit 90 includes a current-limiting resistor 92 and a plurality of diodes 94A–94D. The resistor 92 and the diodes 94A–94D couple the lines 68A–68B to an optocoupler 96 as shown. The optocoupler 96 includes a light-emitting diode 98 and a light-receptive semiconductor device 100 operable to couple a line 102 to a line 104 in the event that current causes the light-emitting diode 98 to generate light. The line 102 is coupled to the power supply 74 by a resistor 106 and the line 76. In accordance with the conduction state of the optocoupler 90, an output line 108 (corresponding with one of the lines 71A–71B of FIG. 4) provides to the microcontroller 72 a signal having a voltage representative of either a logic high or logic low. In this manner, the optocoupler 96 advantageously isolates the microcontroller 72 from the AC power provided on the lines 68A–68B.

In operation in connection with the control circuit 50, if the switch 54 is closed, the diodes 94A–94D cause the light-emitting diode 98 to blink (i.e., become dark) at twice the frequency of the power source 32 (e.g., 120 Hz). If the switch 54 is then opened such that the line 68B carries a half-wave rectified signal, the diodes 94A and 94D only allow current to flow through the light-emitting diode 98 for approximately half of a cycle, thereby reducing the blink rate to the frequency of the power source 32 (e.g., 60 Hz). As a result, the signal on the line 108 is either pulsing at 60 Hz or 120 Hz, and can be accordingly analyzed by the microcontroller 72 via any combination of hardware, software, and firmware, the implementation of which is well known to those skilled in the art.

It will be further appreciated by those skilled in the art that a sensing circuit similar to that shown in FIG. 5B may be constructed for use in the embodiment of FIG. 1. For example, such a sensing circuit would still have an optocoupler, albeit with an appropriate current-limiting resistor and blocking diode coupling the optocoupler to the line 44. However, the diodes 94A–94D would be unnecessary because the state of the switch 42 (FIG. 1) would be directly determinative of whether the light-emitting diode should be blinking at all. That is, the line 44 is either floating or carrying an AC signal corresponding to the power line current supplied by the power source. The microcontroller 72 would then receive a pulse stream only when the switch 42 permits the AC signal to reach the sensing circuit.

Figure 6:
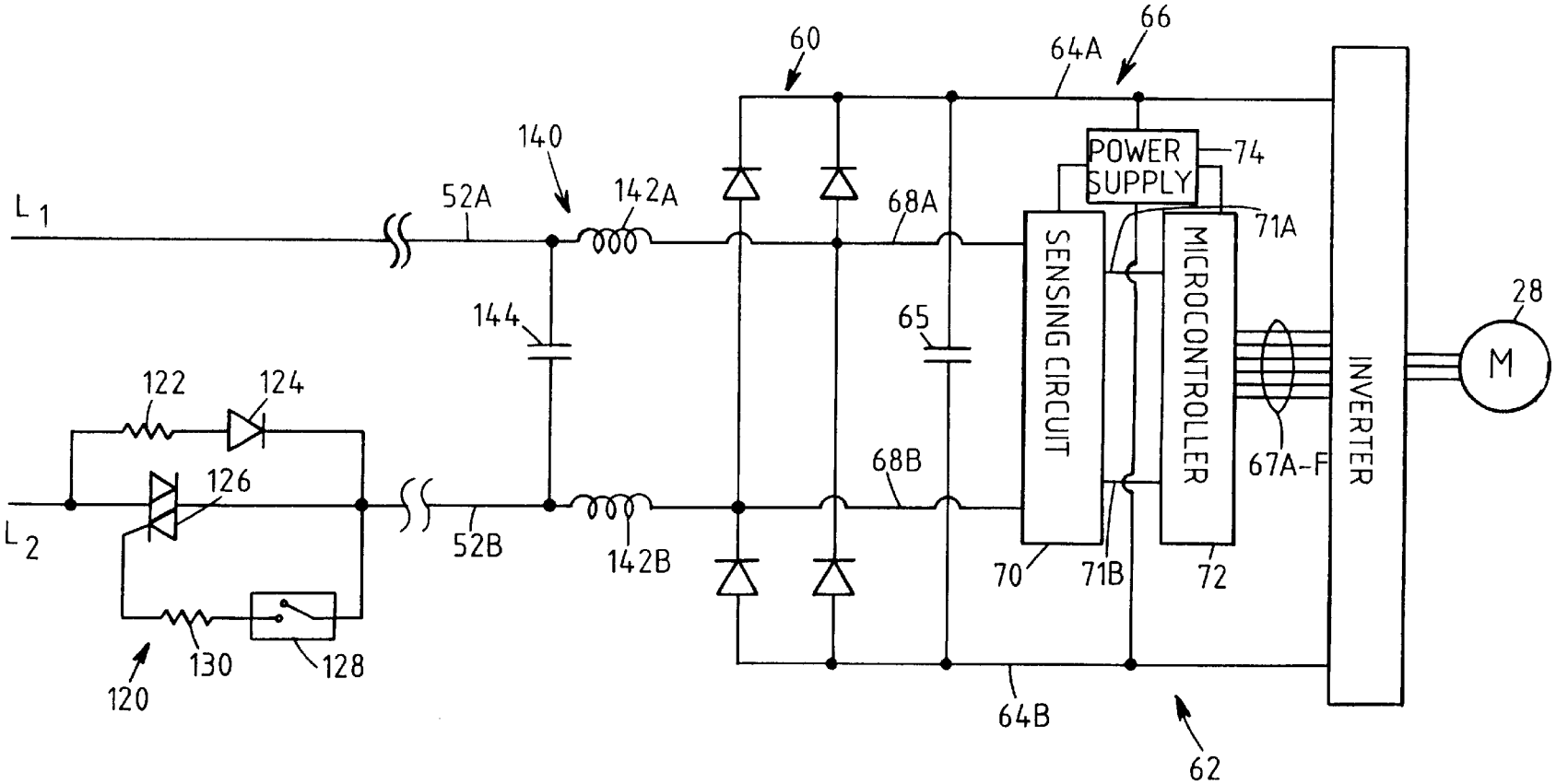
FIG. 6 is a schematic diagram of a control circuit and variable-speed motor drive according to an embodiment of the present invention suited for minimizing electromagnetic interference (EMI) radiation.

FIG. 6 is a schematic diagram of a control circuit 120 according to another embodiment of the present invention, shown together with components of the pump-motor assembly 22. Elements in common with prior embodiments and figures have been identified with like reference numerals. Unlike the embodiment of FIG. 2, the control circuit 120 comprises a bypass circuit coupled to only one of the power conductors $L_1$ or $L_2$ (as shown, $L_2$) such that a resistor 122 and a diode 124 are connected in series across a triac 126. In this manner, the bypass circuit is connected in parallel with the triac 126. The triac 126 may be replaced by a conventional contactor switch or any other type of semiconductor switching device known to those skilled in the art. The particular type of switch, however, is preferably capable of withstanding a large number of switching cycles over the course of the lifetime of the system 10. In this regard, the triac 126 is well-suited for practice of the present invention.

In operation, the bypass circuit and the power conductors 52A and 52B supply power to the variable-speed motor drive 30 regardless of whether the triac 126 has been triggered into its conductive state. As set forth hereinabove, this continuous supply of power maintains the variable-speed motor drive 30 in a ready-to-run mode for handling operation having a high frequency of on-off cycling.

The gate of the triac 126 is driven by a pressure or float switch 128 and a current-limiting resistor 130. The triac 126 is therefore triggered or gated into a conductive state once the pressure or float switch 128 is closed. When the switch 128 is open, the rectifying nature of the diode 124 permits half-wave rectified current to flow to the sensing circuit 70 via the power conductor 52B and the line 68B. Thus, as in the previous embodiments, the state of the pressure or float switch 128 will be determinative of an electrical property of a control signal supplied to the variable-speed motor drive 30. In the same manner as described in connection with FIGS. 4, 5A and 5B, the sensing circuit 70 and the microcontroller 72 of the variable-speed motor drive 30 are then responsive to the electrical property of the signal to control the operation of the pump-motor assembly 22 and, in particular, the variable-speed motor drive 30.

It shall be understood that the control circuit 120 may be incorporated into any of the above-identified embodiments, such as that shown in FIG. 3.

With continued reference to FIG. 6, a filter 140 is disposed between the control circuit 120 and the variable-speed motor drive 30. The filter 140 may include a common mode choke comprising a pair of inductors 142A and 142B disposed in the power conductors 52A–52B, respectively, and a capacitor 144 disposed therebetween. The inductors 142A–142B and the capacitor 144 remove high frequency electromagnetic noise generated by the variable-speed motor drive 30 that would otherwise be propagated back along the power conductors $L_1$ and $L_2$. In this manner, the generation of undesirable electromagnetic interference (EMI) is avoided. As is known to those skilled in the art, other appropriately disposed capacitances and/or inductances may accomplish this same result.

However, diminishing EMI interference using such filter circuits modifies the operation of the sensing circuit 70 and corresponding logic of the microcontroller 72. For instance, in an embodiment incorporating the sensing circuit 70 of FIG. 5A, the capacitor 144 is charged when the switch 128 is open by the half-wave rectified signal provided via the bypass circuit. As a result, the signal on the line 68B is always high with respect to $-V_{DC}/2$, thereby reverse-biasing the zener diode 82B and sending a constant logic high to the microcontroller 72. With regard to an embodiment utilizing the sensing circuit 90 of FIG. 5B, the introduction of the capacitor 144 applies a positive voltage across the light-emitting diode 98 if the switch 128 is open. That is, once the capacitor 144 is sufficiently charged by the half-wave rectified current flowing through the bypass circuit, the opto-coupler 96 continuously provides a constant logic low signal to the microcontroller 72. In each case, the microcontroller 72 is configured or programmed appropriately to interpret these signals as modified by the EMI filter.

Figure 7A:
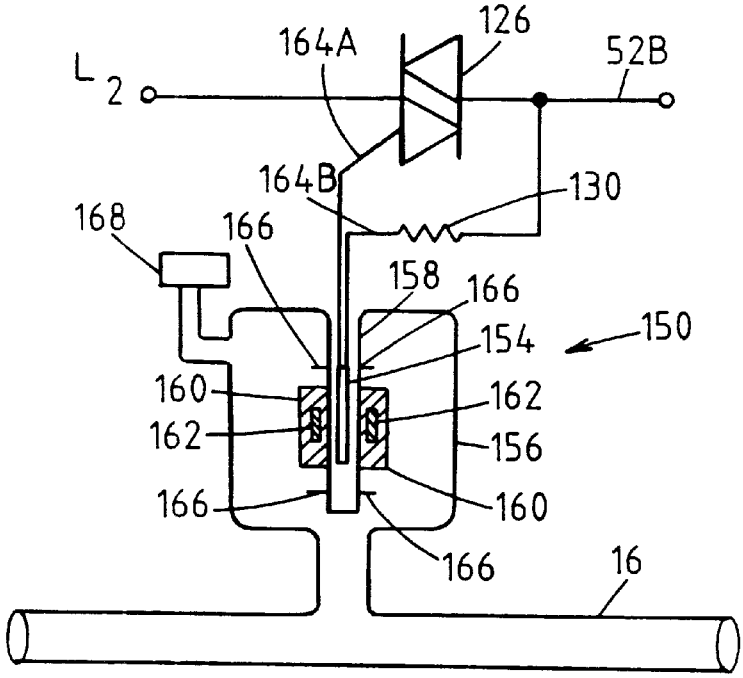
FIG. 7A is a diagrammatic representation of a switch according to one embodiment of the present invention for use in the control circuits of FIGS. 1, 2, and 6.
Figure 7B:
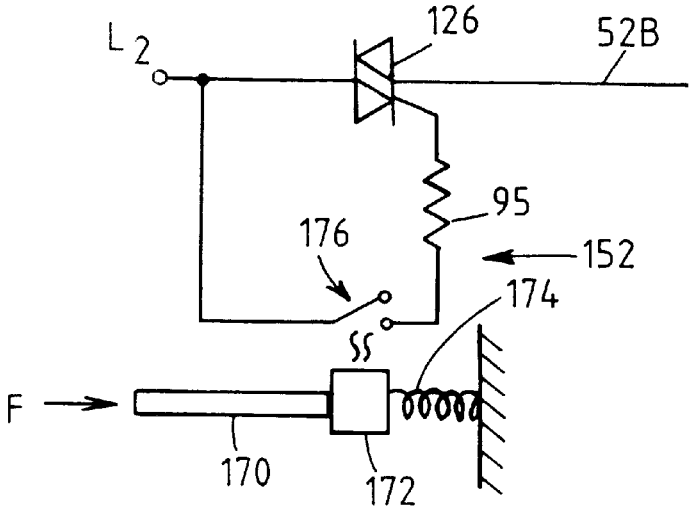
FIG. 7B is a diagrammatic representation of a switch according to another embodiment of the present invention for use in the control circuits of FIGS. 1, 2, and 6.

FIGS. 7A and 7B further provide details on a float (i.e., level) switch 150 and a pressure switch 152, respectively, for use in the control circuit 120 (FIG. 6) and the other embodiments described hereinabove. Accordingly, both the float and pressure switches 150 and 152 are shown coupled to the triac 126 of FIG. 6. In each embodiment, the gate of the triac 126 is driven by components in communication with the liquid in the system 10, for example, a reed switch responsive to either the level or pressure of the liquid in the tank 12.

As shown in FIG. 7A, the float switch 150 comprises a reed switch 154 disposed in a compact tank 156. The compact tank 156 may be located at any point in the system (above the check valve 24), but is shown in FIG. 7A as coupled to the piping 16. In any event, the level of the liquid in the compact tank 156 corresponds with, and is indicative of, the amount of liquid in the tank 12. The reed switch 154 is disposed in a columnar capsule 158 about which a float 160 carrying a magnet 162 is disposed. As is known to those skilled in the art, the reed switch 154 comprises a plurality of metal strips or reeds (not shown) that are attracted together by the magnetic field established by the magnet 162. When the strips contact each other, conductors 164A and 164B couple the gate electrode of the triac 126 to the power conductor 52B. In this manner, the float switch 150 is actuated by the amount of liquid in the system 10, which, of course, is representative of the amount or pressure of liquid in the tank 12.

The capsule 158 may also have stops 166 attached thereto for limiting the range of vertical motion of the float 160 to prevent excessive displacement. Unlike the larger tank 12 used for storing the water, the compact tank 156 preferably does not include a diaphragm, inasmuch as the float 160 needs to be able to move freely between the stops 166. In light of the lack of a diaphragm, the float switch 150 may also include a Schrader or snifter valve 168 for introducing air into the system 10. In this manner, additional air can be added if the air in the system 10 has progressively been absorbed by the liquid (thereby increasing the sensitivity of the system 10 to liquid level changes significantly).

Referring now to FIG. 7B, the pressure switch 152 has a diaphragm (not shown) in communication with the liquid in the piping 16 to sense the system pressure. The uniform nature of the system pressure allows the pressure switch 152 to be disposed anywhere in the system (above the check valve 24) and still sense a pressure indicative of the amount of liquid in the tank 12. The force F exerted on the diaphragm is transferred to a pushrod 170, which, in turn, engages a magnet 172 attached to a spring 174 preferably made of magnetic steel. The magnet 172 and the spring 174 form part of a magnetic circuit with the reeds of a reed switch diagramatically shown at 176. This magnetic circuit has either a high or a low magnetic reluctance depending on the position of the magnet 172 relative to the reed switch 176. More particularly, when the system pressure is low, the spring 174 is relatively uncompressed by the force F, and the resulting position of the magnet 172 generates sufficient magnetic field lines passing through the reeds to close the reed switch 176. When the system pressure rises, the spring 174 is compressed, and the position of the magnet 172 relative to the reeds of the reed switch 176 is such that less magnetic field lines pass through the reed switch 176. Eventually the magnetic field strength is reduced to a point that the reed switch 176 opens.

In one embodiment, the pressure switch 152 utilizes a neodynium-iron magnet, a plastic pushrod, and a steel spring. As will be understood by those skilled in the art, the spring constant of the spring 174 will determine the points at which the reed switch 176 closes and opens. The operation and details of the other components of the pressure switch 152 are further described in U.S. Pat. No. 4,307,327, the disclosure of which is hereby incorporated by reference.

In general, the above-described reed switch/triac combination has been shown to be durable in the frequent on-off cycling characteristic of a domestic water system incorporating the present invention. Such systems may have a lifetime exceeding 100 million on-off cycles. Alternative embodiments of the control circuits 50 and 120 utilizing more mechanical components may be prone to failure over the course of such a lifetime. For example, a pressure switch may close a switch contact rather than gate a triac or other semiconductor switching element. As is well known to those skilled in the art, such switch contacts actually melt to a slight extent with each switching cycle. After thousands of cycles, this melting can result in failure. In contrast, in the triac-based embodiments described hereinabove, any contacts in the triac trigger circuit would not be exposed to the high currents that result in contact melting. Nevertheless, the invention is not limited to such triac-based embodiments, and may in fact be incorporated into a domestic water system that, for example, does not require extreme levels of on-off cycling. Moreover, those skilled in the art may select materials appropriate to limit contact melting to an acceptable degree.

The above-described embodiments utilizing a bypass circuit generally provide the information as to the state of the switch via analysis of the current supplied to the pump-motor assembly 22. Such bypass circuit embodiments may be more desirable than those embodiments relying on an additional conductor because, for example, a two-conductor system may be easier to install, particularly in connection with the conversion of existing domestic water systems. Devoting an additional conductor to signaling, however, allows the power conductors to supply full power to the pump-motor assembly 22 continuously (rather than merely half-wave rectified power). While the variable-speed motor 28 may still be capable of running on the half-wave rectified power supplied by the bypass circuit, the large DC-component of the current drawn by such a load may cause problems for distribution transformers. As a result, merely decreasing motor speed once the switch opens may be problematic. On the other hand, immediately stopping the motor upon the opening of the switch not only defeats one of the primary purposes of utilizing a variable-speed motor, but also may result in motor component wear with frequent on-off cycling.

Figure 8:
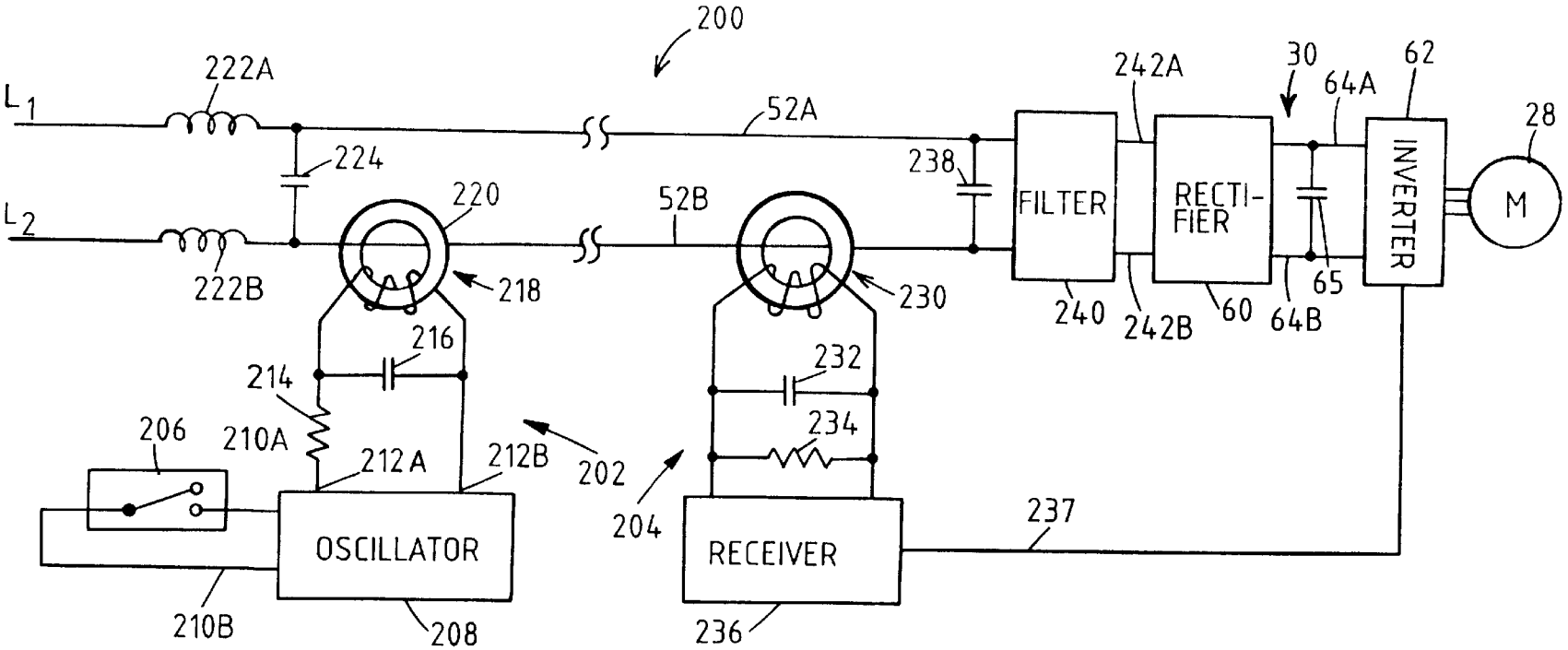
FIG. 8 is a schematic diagram of a control circuit and variable-speed motor drive according to still another embodiment of the present invention.

FIG. 8 is a simplified schematic diagram of another embodiment of the present invention that achieves remote signaling without relying on an additional conductor, but while continuously providing full power to the pump-motor assembly 22. In general, the disposition or state of a switch responsive to the amount of liquid in the tank 12 is communicated via the power conductors 52A and 52B by superposing a high frequency carrier signal on the AC power line current. The power conductors 52A and 52B, thus, form part of a current-carrier circuit 200 that transmits operating condition data from ground level (i.e., near the tank 12) to the pump-motor assembly 12 submersed in the well.

The current-carrier circuit 200 includes a transmitter 202 that generates the high frequency signal and a detector 204 responsive to the high frequency signal for providing the operating condition data to the variable-speed motor drive 30. It should be noted that the detector 204 may be considered a part of the variable-speed motor drive 30, and may or may not be housed therein.

The transmitter 202 is coupled to a switch 206 that is disposed in a state in accordance with the current operating conditions for the system. The switch 206 may comprise a two-position switch such as the float switch 150 of FIG. 7A or the pressure switch 152 of FIG. 7B. In this case, the switch 206 is disposed in one of two states in accordance with whether the tank 12 is in either a high or low liquid condition. Thus, the operating conditions are limited to the amount of liquid in the tank 12. Other switch control schemes may be readily provided by those skilled in the art. For ease in description only, the switch 206 will be assumed to comprise a mechanical pressure switch having a diaphragm in communication with the liquid in the system that operates as described above to toggle between states representative of high and low liquid conditions. In such an embodiment, the pressure switch 206 is configured to enable transmission of a high frequency signal when a low liquid condition is sensed. It should be noted that, in an alternative embodiment, transmission of the high frequency signal could just as easily be representative of a high liquid condition.

The transmitter 202 further includes an oscillator 208 that is preferably coupled to the switch 206 via lines 210A and 210B. When the switch 206 is closed (i.e., meaning the liquid in the tank is low), the switch 206 and lines 210A–B complete a path connecting two nodes within the oscillator 208 to permit the oscillator 208 to develop a high frequency signal across output terminals 212A–212B. The high frequency signal passes through an RC circuit having a resistor 214 and a capacitor 216 having respective component values selected to form a resonant circuit with the secondary winding of a transformer 218. More particularly, the resistance of the resistor 214 and the capacitance of the capacitor 216 are selected such that, together with the inductance provided by the transformer 218, the resonant circuit has a bandwidth compatible with the high frequency signal. Furthermore, the capacitor 216 tunes the circuit such that the high frequency signal has a particular frequency, such as about 67 kHz. The transformer 218 thereby inductively couples this high frequency signal to the remainder of the current-carrier circuit 200 for transmission to the detector 204.

The transformer 218 preferably includes a ferrite toroidal core 220, which may be obtained from Fair-Rite Products Corp. (Wallkill, N.Y.) as product number 5977005101. The high permeability of the ferrite core 220 provides for a high inductance (e.g., about 100 $\mu$H) in a small, inexpensive transformer capable of withstanding lightning surges. The primary winding of the transformer 218 corresponds with one of the two power conductors L1 and L2, while the secondary winding may comprise about ten turns of #24 wire. As a result of this configuration, the AC power line current provided by the power source severely saturates the ferrite core when current is flowing between the power conductors L1 and L2. Transmission of the high frequency signal accordingly ceases during such high current periods.

Fortunately, the nature of the variable-speed motor drive 30 is that current flows between the power conductors L1 and L2 for only a fraction of each cycle. In fact, the variable-speed motor drive 30 generally causes current to flow between the power conductors L1 and L2 for only about 25% of each cycle. Transmission of the high frequency signal therefore occurs during the remainder of each cycle.

A network comprising a pair of inductors 222A and 222B, and a capacitor 224, may couple the power conductors L1 and L2 to the pressure switch assembly including the transformer 218 and the above-described components of the transmitter 202. This network determines the impedance seen by the transmitter 202 and, more generally, stabilizes the impedance of the current-carrier circuit 200 for frequencies near the frequency of the high frequency signal. The inductors 222A and 222B and the capacitor 224 may be housed in the same assembly encompassing the transmitter 202 and the pressure switch 206.

The oscillator 208 of the transmitter 202 preferably constitutes a Wein-bridge oscillator enabled by the pressure switch 206. The high frequency signal generated by the oscillator 208 may have a frequency in a range from about 50 kHz to about 200 kHz. The component values set forth hereinbelow provide a high frequency signal at about 67 kHz.

The detector 204 preferably includes a transformer 230 matching the transformer 218 of the transmitter 202 for efficient inductive coupling of the high frequency signal from the power conductor 52A or 52B. The detector 204 further includes a capacitor 232 and a resistor 234 that are preferably identical to the capacitor 216 and the resistor 214, respectively, such that the detector 204 is appropriately tuned for coupling the high frequency signal to a receiver 236. Each of the capacitors 216 and 232 are preferably close tolerance with a high quality dielectric, such as a 2% tolerance, polypropylene capacitor. Such capacitors are available from Panasonic as, for example, product numbers ECQ-PIH473GZ and ECQ-PIH222GZ. As will be described hereinbelow, the receiver 236 is tuned to be receptive to high frequencies in the range of the high frequency signal generated by the oscillator 208. The receiver 236 then generates a digital signal on a line 237 to provide to the inverter 62 an indication of whether the pressure switch 206 is closed or open.

The current-carrier circuit 200 is completed by a capacitor 238 that, together with the capacitor 224, couples the power conductor L1 to the power conductor L2 to establish a low impedance circuit. Such a low impedance circuit provides for excellent coupling between the transformers 218 and 230 and, therefore, clear transmission of the high frequency signal between the oscillator 208 and the receiver 236. To this end, both of the capacitors 224 and 238 should be capable of clearly passing frequencies on the order of the high frequency signal, while blocking frequencies around 60 Hz. Furthermore, the capacitors 224 and 238 should constitute "across-the-line" capacitors, in that the capacitors 224 and 238 have insulation rated for connecting the two power conductors L1 and L2.

The power conductors 52A and 52B may terminate in a filter 240 designed to block transmission of any high frequency signal components. To prevent such signal components from either entering or exiting the variable-speed motor drive 30, the impedance of the filter 240 is set to pass low frequencies such as the 60 Hz single-phase power line current from the power source. The filter 240 may, of course, be considered a portion of the variable-speed motor drive 30. The filtered power line current generated by the filter 240 is provided on lines 242A and 242B to the rectifier 60.

Alternatively, the transformers 218 and 230 have a powered-iron core. While the lower permeability of the powdered iron core (relative to the ferrite core) results in a larger transformer, the powdered iron requires a much higher magnetic field to saturate. Consequently, the transformers 218 and 230 could be designed to not saturate during peak AC power line current. This transformer design would, in turn, allow for uninterrupted carrier transmission. Practice of the present invention, however, does not require such continuous transmission.

Figure 9:
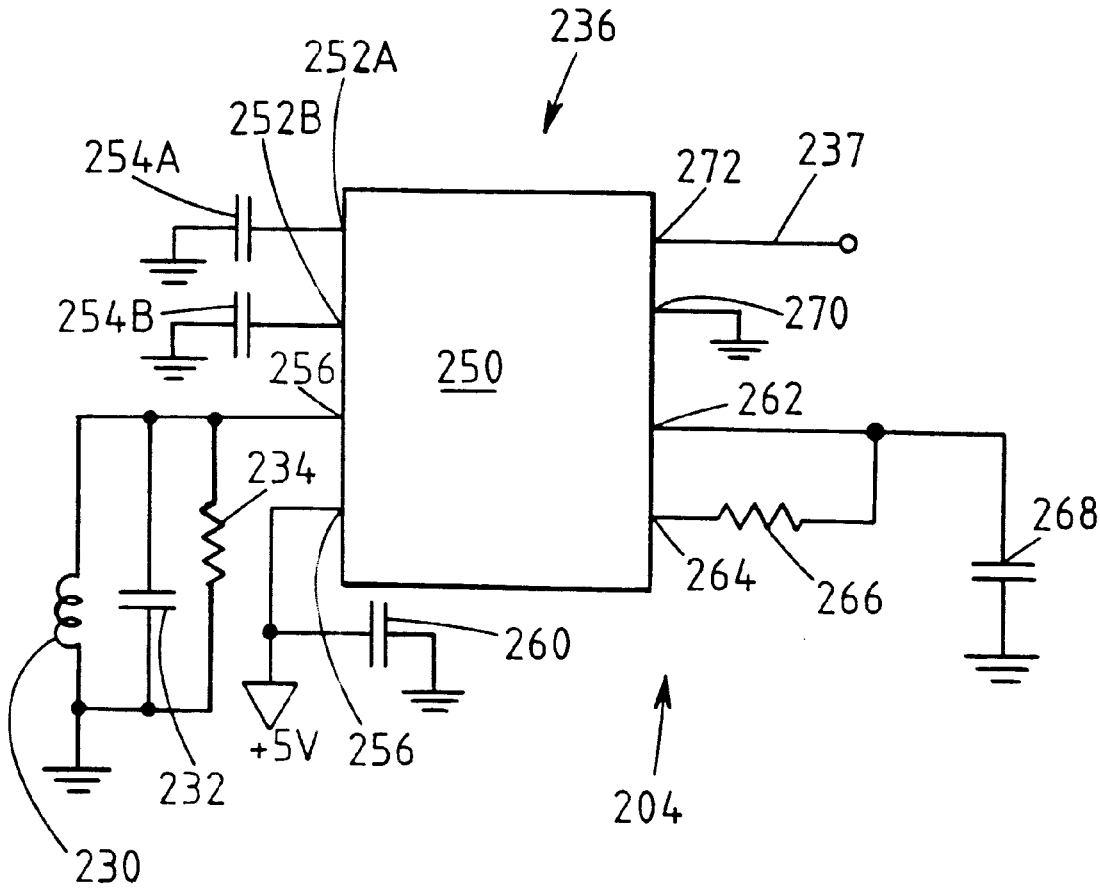
FIG. 9 is a schematic diagram of a detector for use in the control circuit or the variable-speed motor drive of FIG. 8.

One embodiment of the detector 204 is shown in greater detail in FIG. 9, where like elements of FIG. 8 have been identified by like reference numerals. The portion of the detector 204 dedicated to receiving the high frequency signal and generating the digital signal representative thereof on the line 237 (i.e., the receiver 236) includes an integrated circuit chip 250 that constitutes a phase-locked loop circuit well known to those skilled in the art. Several suitable phase-locked loop chips 250 are available from various manufacturers. The particular phase-locked loop chip 250 shown in FIG. 9 corresponds with a schematic representation of National Semiconductor product number LMC567, which provides a low logic level output whenever the high frequency signal is detected.

Each of the terminals or pins of the phase-locked loop chip 250 will now be described in connection with the circuitry coupled thereto. The circuitry coupled to the phase-locked loop chip 250 generally sets the center frequency and the bandwidth for the phase-locked loop chip 250. More particularly, the phase-locked loop chip 250 has a pair of input terminals 252A and 252B to which a pair of capacitors 254A and 254B are coupled, respectively. The component values (see hereinbelow) of the capacitors 254A and 254B are selected to determine an appropriate bandwidth and other dynamic parameters for the phase-locked loop chip 250. Both of the capacitors 254A and 254B are shown coupled to a ground terminal, which should be understood for all of FIG. 9 (as well as FIG. 10) to constitute a relative circuit reference ground rather than earth ground. The phase-locked loop chip 250 has a further input terminal 256 that receives the input signal picked off the power conductor 52A or 52B by the transformer 230. A terminal 258 is coupled to a 5 Volt DC power supply, which may correspond with the power supply 74 (FIG. 6). A bypass capacitor 260 also coupled to the terminal 256 removes any undesirable high frequency noise from the DC power supply. Input terminals 262 and 264 are coupled to an RC circuit comprising a resistor 266 and a capacitor 268 that together set the center frequency for the phase-locked loop chip 250. The capacitor 268 is preferably of the 2% tolerance, polypropylene type, as described hereinabove. The reference ground for the phase-locked loop chip 250 is established by an input terminal 270. Lastly, the line 237 coupling the detector 204 to the inverter 62 is coupled to an output terminal 272 of the phase-locked loop chip 250.

Figure 10:
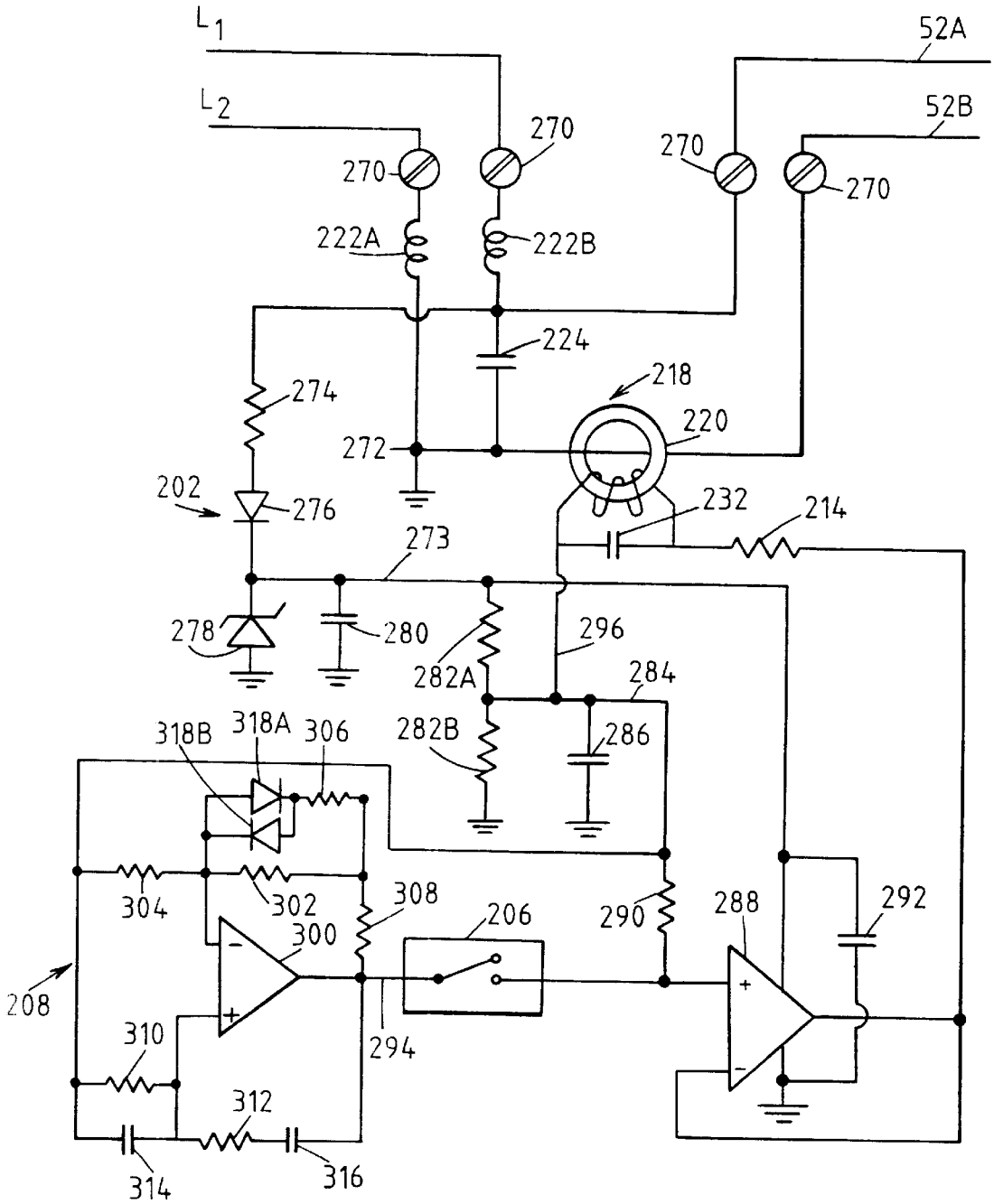
FIG. 10 is a schematic diagram of a transmitter for use in the control circuit of FIG. 8.

FIG. 10 shows one embodiment of the transmitter 202 designed for operation in conjunction with the detector 204 of FIG. 9. The power conductors L1 and L2 are coupled to a pressure switch assembly via a plurality of screw terminals 270 that provide input and output terminals for the transmitter 202. On the input side, the screw terminals 270 are coupled to the transformer 218 by the network comprising the inductors 222A and 222B and the capacitor 224. The inductors 222A and 222B preferably comprise typical AC line chokes for suppressing EMI radiation generated by a variable-speed motor drive. The AC line chokes may be designed in accordance with Catalog 4 of Micrometals, Inc. (Anaheim, Calif.), the disclosure of which is hereby incorporated by reference. As shown, the circuit reference ground is defined as the voltage at a node 272, to which all other connections to reference ground shown in FIG. 10 refer, accordingly.

As shown in FIG. 8 as well, the power conductor 52B has the high frequency signal inductively coupled thereto via the transformer 218. The other power conductor L2 (or 52B) establishes a DC power source on a line 273 of preferably about 12 Volts via a power conversion circuit having a resistor 274, a diode 276, a voltage-regulating Zener diode 278 (with an appropriate breakdown voltage), and a capacitor 280. A voltage divider having a pair of resistors 282A–282B steps down the 12 Volt DC power to provide, for example, 6 Volt DC power on a line 284. A capacitor 286 may be coupled to the line 284 to stabilize the 6 Volt DC signal. The 6 Volt DC signal is provided to a non-inverting input terminal of an op-amp 288 via a resistor 290, while the 12 Volt DC power drives the op-amp 288. A capacitor 292 may couple the line 273 to the reference ground input terminal of the op-amp 288 to establish stable power therefor.

The op-amp 288 is connected as a unity-gain buffer amplifier to pass the high frequency signal generated by a Wein-bridge oscillator (as part of the oscillator 208) and drive the inductive coupling accomplished by the transformer 218. The oscillator 208 preferably generates an 8 Volt peak-to-peak signal on a line 294 that is coupled to the pressure switch 206, which may, for example, constitute a mechanical pressure switch as illustrated in FIGS. 7A or 7B, or a unit manufactured by Barksdale, Inc. (Los Angeles, Calif.). Therefore, the line 294 may correspond with one of the lines 210A–210B of FIG. 8. In the event that the pressure switch 206 senses a low system pressure indicating that the liquid in the tank 12 is at a low level, the 8 V peak-to-peak high frequency signal is combined with the 6 Volt DC signal and provided to the buffer op-amp 288. The high frequency signal is now centered at 6 Volts and oscillating between 2 and 10 Volts, thereby allowing operation of the op-amps 292 and 300 from a single supply.

When the pressure switch 206 is open, the output of the buffer op-amp 288 is at about a 6 Volt DC level established on the line 284. The tuned coupler circuit consisting of the resistor 214, the capacitor 216, and the transformer 218 then have zero AC excitation such that no carrier transmission occurs.

When the pressure switch 206 is closed, the output signal of the op-amp 288 is provided to the transformer 218 via the resistor 214 and the capacitor 232. The transformer 218 sees the high frequency signal as a pure sinusoid with no DC component for the reasons set forth hereinabove. The losses introduced by the resistor 214 determine the bandwidth for the current-carrier circuit 200. This bandwidth is preferably sufficiently broad to compensate for unit to unit variation in component values (e.g., the capacitor 216 and the transformer 218).

A preferred embodiment of the oscillator 208 will now be further described. The oscillator 208 includes an op-amp 300 configured for operation as a Wein-bridge oscillator based on the 6 Volt DC signal developed on the line 284. The feedback paths for the op-amp 300 are generally consistent with the well-known design for a Wein-bridge oscillator, and include resistors 302, 304, 306, 308, 310, and 312, along with capacitors 314 and 316, and diodes 318A and 318B (which may obtained from General Semiconductor, Inc., Melville, N.Y., as product number IN914).

The op-amps 288 and 300 may form two sections of a dual op-amp, which is available from National Semiconductor Corp. (Santa Clara, Calif.) as product number LF353. In general, the op-amps 288 and 300 should have a sufficient gain-bandwidth product to oscillate at the desired carrier frequency, as will be known by those skilled in the art. For example, for a 67 kHz carrier signal, a gain-bandwidth product of approximately 4 MHZ is sufficient.

Figure 11:
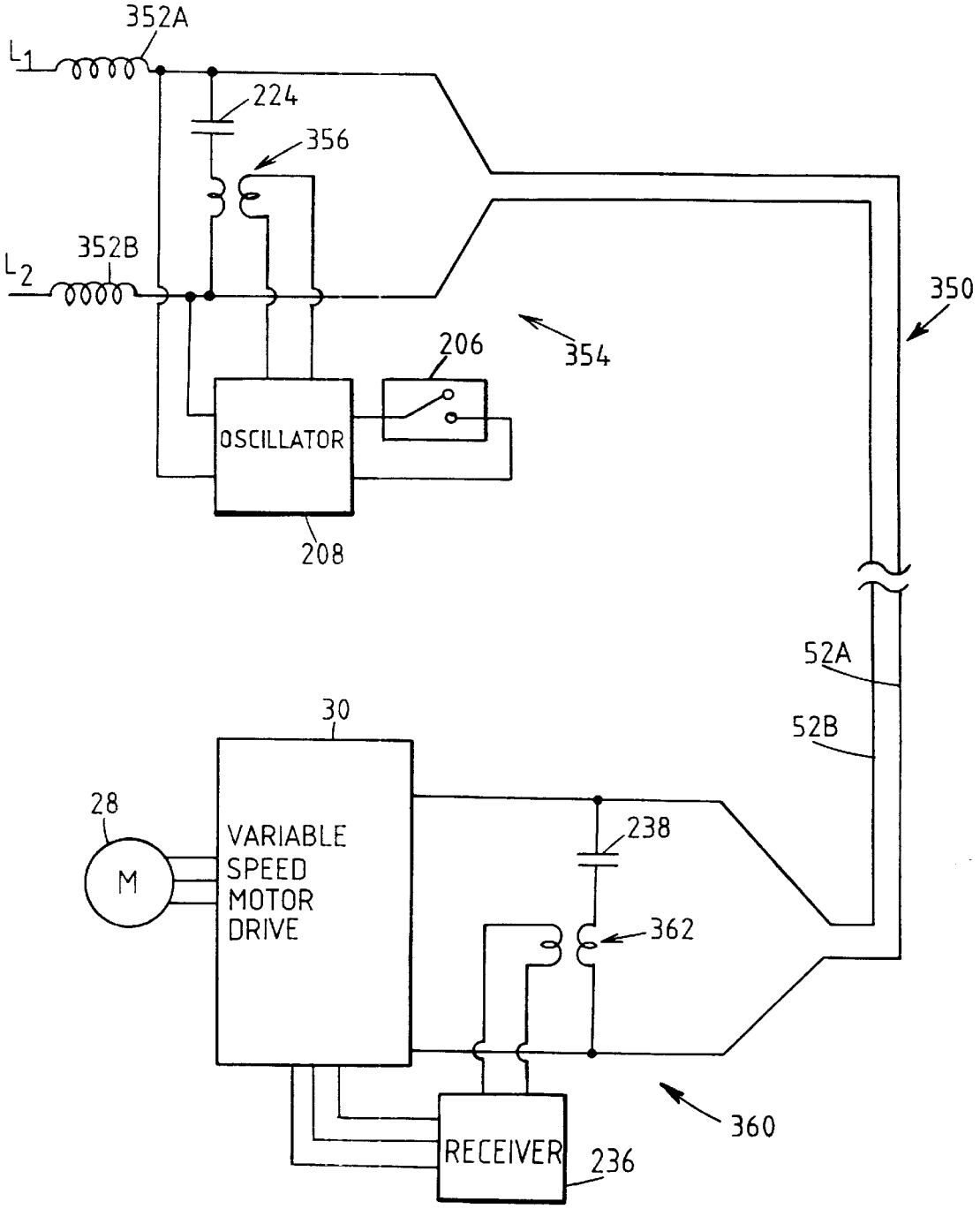
FIG. 11 is a schematic diagram of a control circuit and variable-speed motor drive according to yet another embodiment of the present invention.

FIG. 11 is a simplified schematic representation of an alternative embodiment of the current-carrier circuit wherein the transformers are not exposed to the AC currents flowing between the power conductors L1 and L2. Elements found in previously described figures have been identified with like reference numerals. In particular, a current-carrier circuit 350 includes a pair of inductors 352A–352B that pass the 60 Hz AC power carried by the power conductors L1 and L2, but block the above-described 67 kHz carrier signal generated by the oscillator 208 of a modified transmitter 354. The modified transmitter 354 may still include a mechanical or electrical pressure switch 206 for enabling and disabling the oscillator 208. Furthermore, the oscillator 208 may correspond in all pertinent respects with the circuit components shown and described in connection with FIG. 10.

The transmitter 354 differs from the above-described transmitter in the manner in which the high frequency signal is inductively coupled to the power conductors 52A and 52B. Specifically, a transformer 356 is located between the power conductors 52A and 52B such that the primary winding of the transformer 356 is directly in series with the capacitor 224. In this manner, the transformer 356 is not exposed to the large AC current periodically flowing between the power conductors L1 and L2. As a result, the transformer 356 does not saturate at any point in the AC power cycle. As a further result, the high frequency carrier signal is superimposed on the power conductors L1 and L2 throughout the cycle, meaning that the inductors 352A–352B should be designed to not saturate at any point in the AC power cycle, such that the high frequency carrier signal is always blocked from entering the household wiring system. With that one exception, the transformer 356 may be identical to any of the transformers described hereinabove in connection with the transformer 218. Alternatively, the transformer 356 comprises a transformer available from Toko America, Inc., Mount Prospect, Ill., as product number RWOS-6A7694AO.

At the other end of the current-carrier circuit 350, a detector 360 includes a transformer 362 that inductively couples the receiver 236 to the current-carrier circuit 350 between the power conductors 52A–52B as shown. The capacitor 238 may again be utilized to block the 60 Hz AC power but complete the high frequency current-carrier circuit 350. The receiver 236 may be similar in all pertinent respects to the circuit components described and shown in connection with FIG. 9.

The current-carrier circuit 350 provides for continuous transmission of the state of the pressure switch 206, rather than the intermittent transmission of the embodiment shown in FIG. 8. As a result, the microcontroller of the inverter 62 need not account for interruptions in the remote signaling of each 60 Hz power cycle. However, it should be noted that an appropriately configured microcontroller can readily be designed for either embodiment by those skilled in the art.

The present invention is not limited to use with a single-phase power source. In an alternative embodiment, the power source 32 supplies three-phase power over three power conductors. In this case, the conductor 40 of the embodiment of FIG. 1 may be coupled to any one of the three power conductors carrying current from the three-phase power source. With respect to the embodiment of FIG. 2, an additional resistor (similar to the resistor 58) may be included to accommodate the third power conductor. Lastly, the embodiment of FIG. 6 would not be significantly modified by the addition of another power conductor carrying current to the pump-motor assembly 22 because the control circuit 120 is disposed in a single line. Of course, in each of these instances, the rectifier 60 of the variable-speed motor drive 30 would have to be modified to establish a DC link from which the variable frequency, three-phase power for the motor 28 can be generated, as is well known to those skilled in the art.

The following approximate resistances, inductances, and capacitances set forth below may be utilized in connection with the various embodiments of the present invention:

| | |
|---|---|
| Resistor 58 | 100 Ohms |
| Capacitor 65 | 1.0 μF per watt of drive rating |
| Resistors 80A–80B | 33 kOhms |
| Resistor 92 | 22 kOhms |
| Resistor 106 | 10 kOhms |
| Resistor 122 | 100 Ohms |
| Resistor 130 | 1.0 kOhms |
| Capacitor 144 | 0.33 μF |
| Resistor 214 | 221 Ohms |
| Capacitor 216 | 0.047 μF |
| Inductor 222A–222B | 50 μH |
| Capacitor 224 | 0.33 μF |
| Capacitor 254A | 0.01 μF |
| Capacitor 254B | 0.0022 μF |
| Capacitor 260 | 0.1 μF |
| Resistor 266 | 2.21 kOhms |
| Capacitor 268 | 0.0022 μF |
| Resistor 274 | 10 kOhms |
| Capacitor 280 | 100 μF |
| Resistor 282A–282B | 10 kOhms |
| Capacitor 286 | 0.22 μF |
| Resistor 290 | 10 kOhms |
| Capacitor 292 | 0.1 μF |
| Resistor 302 | 10 kOhms |
| Resistor 304 | 1000 Ohms |
| Resistor 306 | 475 Ohms |
| Resistor 308 | 1000 Ohms |
| Resistor 310 | 1000 Ohms |
| Resistor 312 | 1000 Ohms |
| Capacitor 314 | 0.0022 μF |
| Capacitor 316 | 0.0022 μF |

Numerous other modifications and alternative embodiments of the invention will be apparent to those skilled in the art in view of the foregoing description. Accordingly, this description is to be construed as illustrative only. The details of the structure may be varied substantially without departing from the spirit of the invention, and the exclusive use of all modifications which are within the scope of the appending claims is reserved.

What is claimed is:

1. A pump system for providing liquid to a tank, comprising:

a variable-speed motor drive;

a pair of conductors coupled to the variable-speed motor drive to supply power to the variable-speed motor drive; and a switch disposed in a state in accordance with an amount of liquid in the tank wherein:

the switch is coupled to at least one conductor of the pair of conductors for control of the variable-speed motor drive; and power is supplied to the variable-speed motor drive via the pair of conductors regardless of the state of the switch.

2. The pump system of claim 1, further comprising a third conductor coupling the switch to the variable-speed motor drive.

3. The pump system of claim 1, further comprising a bypass circuit connected to at least one of the pair of conductors in parallel with the switch.

4. The pump system of claim 3, wherein:

the bypass circuit includes a rectifying element; and the pump system further comprises a sensor coupled to the variable-speed motor drive that detects whether the pair of conductors are supplying half-wave rectified power.

5. The pump system of claim 1, wherein the switch comprises a triac gated by a pressure switch in communication with the liquid.

6. The pump system of claim 5, wherein the pressure switch comprises a reed switch responsive to a position of a magnet determined by the pressure of the liquid.

7. The pump system of claim 1, further comprising a transmitter coupled to the switch and the pair of conductors to generate a high frequency signal on the pair of conductors representative of the state of the switch.

8. The pump system of claim 7, further comprising a detector coupled to the pair of conductors and the variable-speed motor drive and responsive to the high frequency signal to control the variable-speed motor drive.

9. The pump system of claim 8, wherein the transmitter comprises an oscillator and the detector comprises a phase-locked loop circuit.

10. The pump system of claim 8, wherein the transmitter and the detector are coupled to the pair of conductors via respective transformers.

11. The pump system of claim 10, further comprising a pair of capacitors connected across the pair of conductors.

12. The pump system of claim 11, wherein:

the transmitter and the detector are coupled to the pair of conductors via a respective transformer; and each transformer, together with a respective capacitor of the pair of capacitors, couples the pair of conductors together.

13. A pump system powered by a power source to provide liquid to a tank, comprising:

a variable-speed motor drive; and a control circuit coupled to the power source and the variable-speed motor drive wherein the control circuit comprises:

a switch disposed in a state in accordance with an amount of liquid in the tank; and a bypass circuit connected in parallel with the switch that allows power to be supplied to the variable-speed motor drive from the power source regardless of the state of the switch.

14. The pump system of claim 13, wherein:

the switch is disposed in a first state during a low liquid condition and a second state during a high liquid condition;

the variable-speed motor drive comprises a rectifier and an inverter;

the rectifier is supplied with power from the power source via the bypass circuit when the switch is disposed in either the first state or the second state; and the inverter is responsive to the state of the switch to provide three-phase power to a motor coupled to the variable-speed motor drive during the low liquid condition.

15. The pump system of claim 13, further comprising a first power conductor and a second power conductor that couple the variable-speed motor drive to the power source wherein at least one of the first power conductor and the second power conductor is coupled to the switch such that a signal having an electrical property determined by the state of the switch is supplied to the variable-speed motor drive.

16. The pump system of claim 15, wherein the switch comprises:

a pressure switch in communication with the liquid; and a triac gated by the pressure switch and coupled to the first power conductor.

17. The pump system of claim 13, wherein the bypass circuit comprises a rectifier such that the variable-speed motor drive is supplied with half-wave rectified power when the switch is open.

18. The pump system of claim 17, further comprising a sensor coupled to the control circuit that detects whether the variable-speed motor drive is supplied with half-wave rectified power via the rectifier of the bypass circuit.

19. A pump system for providing liquid to a tank, comprising:

a variable-speed motor drive;

a pair of conductors coupled to the variable-speed motor drive to supply power thereto;

a transmitter inductively coupled to the pair of conductors to generate a high frequency signal representative of an amount of liquid in the tank; and a detector coupled to the variable-speed motor drive and inductively coupled to the pair of conductors to receive the high frequency signal therefrom.

20. The pump system of claim 19, further comprising means coupled to the transmitter for indicating the amount of liquid in the tank.

21. The pump system of claim 20, wherein the indicating means comprises a pressure switch disposed in a state in accordance with the amount of liquid in the tank.

22. The pump system of claim 19, further comprising a pair of capacitors connected across the pair of conductors.

23. The pump system of claim 22, wherein:

the transmitter and the detector are coupled to the pair of conductors via a respective transformer; and each transformer, together with a respective capacitor of the pair of capacitors, couples the pair of conductors together.

24. The pump system of claim 19, wherein the transmitter comprises an oscillator.

25. The pump system of claim 24, wherein the transmitter further comprises an amplifier coupled to the oscillator via a switch that is disposed in a closed state when the amount of liquid in the tank reaches a low level.

26. The pump system of claim 19, wherein the detector comprises a phase-locked loop circuit that develops a digital output signal representative of whether the high frequency signal is present on the pair of conductors.

27. The pump system of claim 26, wherein the variable-speed motor drive comprises a microcontroller responsive to the digital output signal.

28. A control circuit for a pump system having a tank for storing liquid and a variable-speed motor drive, the control circuit comprising:

a switch disposed in a state in accordance with an amount of liquid in the tank;

a bypass circuit connected in parallel with the switch such that the variable-speed motor is supplied with power when the switch is disposed in an open state; and a detector responsive to the power to generate a control signal representative of the state of the switch to control the variable-speed motor drive.

29. The control circuit of claim 28, wherein the switch comprises a pressure switch and a triac gated by the pressure switch.

30. The control circuit of claim 28, wherein the bypass circuit comprises a rectifier such that the power comprises half-wave rectified current.

31. The control circuit of claim 28, wherein the detector comprises an optocoupler.

32. A control circuit for a pump system having a variable-speed motor drive and a tank for storing liquid, the control circuit comprising:

means for indicating an amount of liquid in the tank;

a first power conductor and a second power conductor that supply power to the variable-speed motor drive;

a transmitter coupled to the indicating means and at least one of the first and second power conductors to generate a high frequency signal representative of the amount of liquid in the tank; and a detector coupled to at least one of the first and second power conductors and to the variable-speed motor drive and responsive to the high frequency signal to control the variable-speed motor drive.

33. The control circuit of claim 32, wherein the indicating means comprises a pressure switch disposed in a state in accordance with the amount of liquid in the tank.

34. The control circuit of claim 32, wherein the transmitter and the detector are inductively coupled to at least one of the first and second power conductors via a first transformer and a second transformer, respectively.

35. The control circuit of claim 34, wherein the first and second transformers are saturated by current that powers the variable-speed motor drive.

36. The control circuit of claim 34, further comprising a first capacitance and a second capacitance wherein each of the first capacitance and the second capacitance couples the first power conductor to the second power conductor.

37. The control circuit of claim 36, wherein:

the first capacitance and the first transformer are connected in series to couple the first power conductor to the second power conductor; and the second capacitance and the second transformer are connected in series to couple the first power conductor to the second power conductor.

38. The control circuit of claim 32, wherein the transmitter comprises an oscillator.

39. The control circuit of claim 38, wherein the transmitter further comprises an amplifier coupled to the oscillator and responsive to the indicating means.

40. The control circuit of claim 32, wherein the detector comprises a phase-locked loop circuit.

41. A controller for a variable-speed motor drive provided with current from a power source for pumping liquid to a tank, the controller comprising:

a pressure-sensitive device having a diaphragm responsive to an amount of liquid in the tank; and a current-carrier circuit having a transformer and coupled to the pressure-sensitive device and the variable-speed motor drive to provide to the variable-speed motor drive a signal indicative of the amount of liquid in the tank wherein the current saturates the transformer.

42. The controller of claim 41, wherein the current-carrier circuit comprises an oscillator coupled to the transformer that generates a high frequency signal.

43. The controller of claim 42, wherein the pressure-sensitive device comprises a switch having a state determined by a position of the diaphragm.

44. The controller of claim 43, wherein the current-carrier circuit further comprises an amplifier coupled to the oscillator by the switch.

45. The controller of claim 41, wherein the transformer comprises a ferrite core.

* * * * *